United States Patent [19]

Kostoff, II

[11] 4,152,083

[45] May 1, 1979

[54] MARGIN CONTROL FOR PRINTING APPARATUS

[75] Inventor: Stanley J. Kostoff, II, Chicago, Ill.

[73] Assignee: Teletype Corporation, Skokie, Ill.

[21] Appl. No.: 823,479

[22] Filed: Aug. 10, 1977

[51] Int. Cl.[2] ..... B41J 25/30

[52] U.S. Cl. ..... 400/342; 400/328

[58] Field of Search ..... 197/19, 63, 66, 82, 197/84 R, 84 A, 84 B; 400/322, 328, 342

[56] References Cited

U.S. PATENT DOCUMENTS

| | | | |
|---|---|---|---|
| 3,463,081 | 8/1969 | Levine | 101/93 |
| 3,554,347 | 1/1971 | Perkins | 197/82 UX |
| 3,631,957 | 1/1972 | Terry | 197/19 |
| 3,647,041 | 3/1972 | Davis et al. | 197/19 |
| 3,757,921 | 9/1973 | Bishop | 197/19 |
| 3,786,429 | 1/1974 | Goldman et al. | 197/19 X |
| 3,812,945 | 5/1974 | Koplow et al. | 197/19 |
| 3,895,704 | 7/1975 | Norris | 197/19 |
| 3,915,278 | 10/1975 | Spence et al. | 197/19 |
| 3,923,137 | 12/1975 | Kashio | 197/19 |
| 3,982,622 | 9/1976 | Bellino et al. | 197/1 R |
| 4,058,195 | 11/1977 | Fravel et al. | 197/53 X |

*Primary Examiner*—Paul T. Sewell

*Attorney, Agent, or Firm*—W. K. Serp; J. C. Albrecht

[57] ABSTRACT

A printing apparatus having a moving carriage with a snap action switch mounted thereon to initialize the left and right margins of the printing apparatus. The carriage is moved to the left until the snap action switch strikes a stop on the frame of the machine. The carriage is then moved a predetermined distance to the right, and a left margin counter is set to zero while a right margin counter is set to a count representative of the width of printing between margins. The counters are incremented and decremented by movement of the carriage with the zero point of each counter representing presence of the carriage at that associated margin. Manual devices are provided for setting a narrower printing field with wider margins at either side by resetting the margin counters. Also, a margin release allows movement of the carriage outside of the narrowed printing field but never outside of a maximum printing field.

5 Claims, 1 Drawing Figure

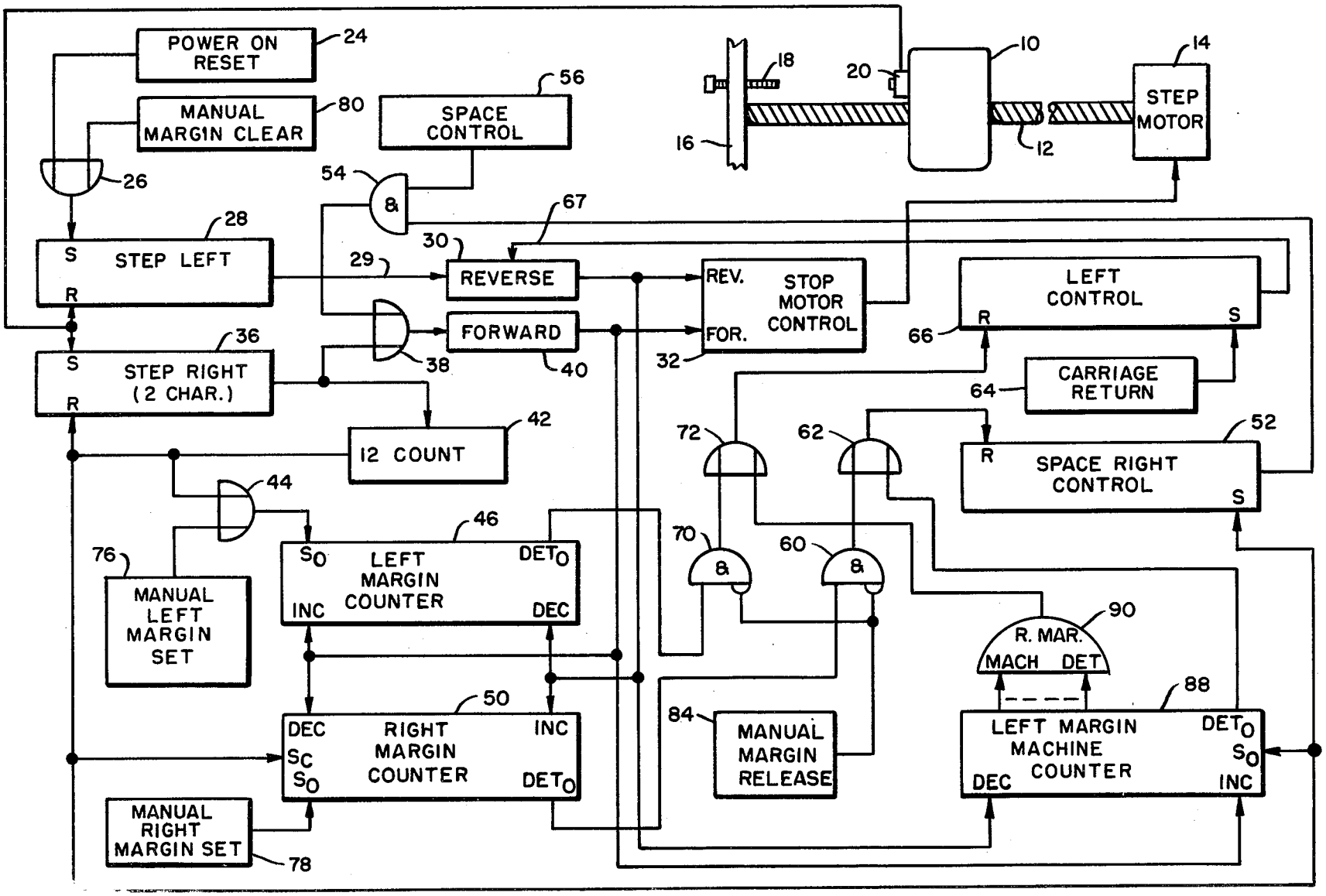
STEP MOTOR
14
12
10
20
18
16
LEFT CONTROL
S
R
66
CARRIAGE RETURN
64
SPACE RIGHT CONTROL
52
STOP MOTOR CONTROL
REV.
FOR.
32
62
60
72
70
LEFT MARGIN MACHINE COUNTER
DET
INC
DEC
88
R. MAR.
MACH DET
90
MANUAL MARGIN RELEASE
84
SPACE CONTROL
56
67
REVERSE
30
FORWARD
40
42
12 COUNT
LEFT MARGIN COUNTER
46
RIGHT MARGIN COUNTER
50
54
29
38
POWER ON RESET
24
MANUAL MARGIN CLEAR
80
26
STEP LEFT
28
STEP RIGHT (2 CHAR.)
36
44
MANUAL LEFT MARGIN SET
76
MANUAL RIGHT MARGIN SET
78

MARGIN CONTROL FOR PRINTING APPARATUS

FIELD OF THE INVENTION

The present invention relates to printing apparatus and more particularly to a system for initializing and controlling the right and left margins of a printing apparatus.

BACKGROUND OF THE INVENTION

In apparatus of the type disclosed in U.S. Pat. No. 3,982,622, granted on Sept. 28, 1976, to J. A. Bellino et al. alphanumeric indicia are printed on paper that is wrapped around a printing platen. The printing is accomplished by selectively printing columns of dots in rows across the paper from a left-hand margin to a right-hand margin. The combinations of columns of selectively printed dots form the shapes of the alphanumeric characters. In controlling such a printing apparatus, it is necessary to keep track of the position of the carriage. It is particularly important to prevent the carriage from proceeding too far to the left or the right so as to exceed the width of the paper or to strike the framework of the printing apparatus.

U.S. Pat. No. 3,923,137, granted on Dec. 2, 1975, to Kashio discloses digital storage for storing the printing position count corresponding to the left margin and the printing position count corresponding to the right margin. A print position counter than keeps track of the location of the printing apparatus. Coincidence circuits are used to indicate when the printing apparatus has reached a margin of the printer. A return switch on the printing apparatus of the Kashio patent detects the return of the print head to the starting position. Similarly, a switch is provided on the printing apparatus for detecting the arrival of the printing head at the rightmost position of the printing field.

U.S. Pat. No. 3,463,081, granted on Aug. 26, 1969, to A. B. Levine, discloses a ring counter having a number of stages equal to the maximum number or columns of symbols to be printed in each line, to keep track of the printing of characters across the width of a page. However, the Levine patent relates to a belt printer.

SUMMARY OF THE INVENTION

In accordance with the present invention, the margins of a page printer are determined in response to a margin initializing signal to move the carriage in a first direction, terminating movement in a first direction in response to sensing that the carriage has reached the frame of the printer and moving the carriage in a second direction for a predetermined distance and then setting the maximum limits of carriage motion in the first and second direction and controlling movement of the carriage to terminate motion thereof in any direction when a limit of motion is reached. Advantageously, this margin-setting system provides ready control of the location of the carriage coupled with recognition of the advance of the carriage to either margin without the need for special detection circuitry, and also facilitates manual setting of the margins of the printing apparatus.

BRIEF DESCRIPTION OF THE DRAWING

A more complete understanding of the present invention may be had by referring to the following detailed description when considered in conjunction with the accompanying drawing which shows a schematic block diagram of a logic system for implementing the preferred form of the present invention.

DETAILED DESCRIPTION

Referring now to the accompanying drawing, the printing apparatus is represented by a carriage 10 that is mounted for translation to the left or to the right on a lead screw 12 that is driven by a stepping motor 14. The lead screw 12 is rotatably mounted in a side frame member 16 which is fixed to the base (not shown) of the printing apparatus. An adjustable stop such as a screw 18 is mounted in the side frame 16 and is aligned with the push button of a snap-action switch 20 that is mounted for translation with the carriage 10.

In accordance with the abovementioned Bellino et al. patent, the stepping motor steps one individual step for each column of dots printed by the printing mechanism that is mounted on or a part of the carriage 10. Therefore, each step of the stepping motor 14 advances the carriage 10 by a distance represented by one dot width of a dot matrix printing font.

As long as the printer is in the ON condition, the electronic controls for the printing apparatus keep track of the location of the carriage 10. However, when the power supplied to the entire printer is OFF, it is unlikely that the carriage 10 will remain in any given location. There will be no detenting action of the stepping motor 14 and the carriage 10 can readily be moved by hand on its lead screw 12. Also, the electronic circuit which operates the printing apparatus may well lose all memory including carriage location during a period when power is not supplied to the printer.

Consequently, most modern electronic circuits, including printer-control circuits, contain some form of auxiliary circuit which senses that power is first being turned ON and institutes a routine to reset all of the circuitry of the electronic device to a known, "zeroed" condition. Such a power-ON reset circuit 24 issues a signal whenever electric power for the system has just been turned ON. The power-ON reset signal from the power-ON reset circuit 24 is passed through an OR-gate 26 to become a margin initializing signal and sets a step-left circuit 28 into operation.

The step-left circuit 28 generates stepping signals to operate the stepping motor 14 at an appropriate frequency to move the carriage to the left at a well-controlled rate. The step-left circuit 28 could, for example, comprise a bistable circuit which controls a pulse-generating oscillator capable of generating output pulses at the desired frequency.

The output of the step-left circuit 28 is delivered to an input 29 of a reverse-driving circuit 30 which might be nothing more sophisticated than an amplifier or it may contain a substantial amount of gating and pulse shaping, depending upon the nature of the specific drive for the stepping motor 14. The output of the reverse driving circuit 30 energizes the reverse input of a step motor control circuit 32. The step motor control circuit may be a ring counter which energizes driving amplifiers to drive the several phases or poles of the step motor 14. A typical step motor control system is illustrated in U.S. Pat. No. 4,107,595, issued to W. T. Campe, on Aug. 15, 1978, entitled "Current Control System for a Stepping Motor" or in U.S. Pat. No. 4,107,594, issued to N. A. Jacobs on Aug. 15, 1978, entitled "Step Motor Velocity Control."

The step-left circuit 28 continues to cause the step motor 14 to move the carriage 10 to the left until the snap-action switch 20 strikes the end of the screw 18, thereby indicating that the carriage 10 has moved as far to the left as possible. The output from the snap-action switch 20 is delivered to a reset input of the step-left circuit 28 in order to prevent the issuance of any more step-left signals. Therefore, the carriage 10 will never get any further to the left than the point at which the snap-action switch 20 operates.

The same signal which resets or turns OFF the step-left circuit 28 sets or starts a step-right circuit 36. The purpose of the step-right circuit 36 is to remove the carriage 10 from the side frame 16 by a predetermined moderate distance in order to assure that the snap-action switch 20 stays a substantial distance away from the screw 18 and thus restores to the unoperated state during the normal operation of the printing apparatus. Snap-action switches last longer if not exercised too often. Thus this switch is utilized when the margin circuit only is initialized or restored. A snap-action switch is used to sense the side frame 16; because, snap-action switches give more certain binary outputs than might be obtained from a simple, spring-loaded electrical contact pair.

As in the case of the step-left circuit 28, the step-right circuit 36 generates a series of pulses at a predetermined rate until it is reset. As in the case of the step-left circuit 28, the step-right circuit 36 may be a bistable circuit that controls an oscillator or pulse generator of the requisite frequency.

The output of the step-right circuit 36 is delivered through an OR-gate 38 to a forward-driving circuit 40 which may be similar to the reverse-driving circuit 30. The output of the forward-driving circuit 40 is delivered to the forward input of the step-motor control 32 in order to drive the step motor 14 in the forward direction, which drives the carriage 10 to the right across the printing platen. A counter 42 also receives the output pulses from the step-right circuit 36 and counts these step-right pulses until it reaches a count of twelve. Twelve steps of the stepping motor 14 correspond approximately to the width of two alphanumeric characters printed by the printing apparatus. The width of two alphanumeric characters is a sufficient distance to remove the carriage 10 from the side frame 16.

When the counter 42 reaches a count of twelve, it delivers an output signal which resets to stop the step-right circuit 36 and prevents the issuance of any more step-right signals therefrom. In addition, the output of the counter 42 is delivered through an OR-gate 44 to the set-to-zero input of the left-margin counter 46. The energization of the set-to-zero input of the left-margin counter 46 sets that counter to a count of zero.

The output of the counter 42 is also delivered to the set-to-a-count input of a right-margin counter 50. The right-counter margin 50 is much the same as the left-margin counter 46 and has facility for being reset either to zero or to some non-zero, predetermined count which may be determined by internal connections within the counter 50 or by external circuitry such as a bank of switches which can be manually reset. No matter how the predetermined count is obtained, the output from the counter 42 causes the right-margin counter 50 to be set to a count which represents the width between margins across the paper being printed.

Therefore, when the carriage 10 is at the desired left margin location which is two characters or twelve steps away from the side frame 16, the left-margin counter is set to zero and the right margin counter is set preferably to the number of steps of the motor necessary to progress the carriage from the left margin to the right margin.

As printing proceeds, the step motor 14 drives the carriage from left to right across the width of the paper between margins. The output of the forward-driving circuit 40 is also delivered to an increment input of the left-margin counter 46 and to a decrement input of the right-margin counter 50. Consequently, each time the step-motor control 32 is instructed to cause the step motor 14 to advance one step to the right, the left-margin counter 46 increments one count and the right-margin counter 50 decrements one count.

Conversely, each time that the reverse-driving circuit 30 commands the step-motor control 32 to cause the step motor 14 to move the carriage 10 one step to the left, the output of the reverse-driving circuit 30 is delivered to a decrement input of the left-margin counter 46 and an increment-input of the right margin counter 50. Therefore, each time that the step motor 14 moves the carriage 10 one step to the left, the left-margin counter is decremented one count and the right-margin counter 50 is incremented by one count. Therefore, the left-margin counter 46 at all times contains a count of the number of steps separating the carriage 10 from the zero or left margin position.

The right-margin counter 50 at all times contains a count of the number of steps separating the carriage 10 from the right margin.

At the same time that the left-margin counter 46 is set to zero and the right-margin counter 50 is set to a count by the output of the counter 42, that same output from the counter 42 also sets a space-right control 52. The space-right control need only be a bistable multivibrator since its only purpose is to issue an output to an AND-gate 54. The output from the space-right control 52 is an enable output which is intended to enable the step motor 14 to move the carriage one increment to the right in response to a space-control circuit 56. The signals from the space-control circuit 56 are the commands from the printer-drive circuitry (not shown) that control lateral movement of the carriage in coordination with the printing mechanism of the carriage. The space control 56 may be derived from a carriage motor controller of the type disclosed in U.S. application for patent Ser. No. 750,934, filed on Dec. 15, 1976, in the name of R. H. Heeren. The output of the AND-gate 54 is a step-right command for the step motor 14 and is delivered through the OR-gate 38 to the forward-driving circuit 40 in order to cause the step-motor control 32 to advance the step motor 14 and move the carriage 10 one unit to the right. So long as the space-right control 52 is in its set or binary "1" state, the space-control circuit 56 is capable of advancing the carriage 10 to the right.

As the carriage 10 is advanced from left to right across the printing apparatus, the right-margin counter 50 is decremented until it finally reaches a count of zero. When the right-margin counter 50 reaches a count of zero, its detect-zero output ($DET_o$) delivers an output to an AND-gate 60 which is normally enabled by another input that is an inverting input. Therefore, the detect-zero output of the right-margin counter 50 passes through the AND-gate 60 and an OR-gate 62 to the reset input of the space-right control 52. When the space-right control 52 is reset by the output from the OR-gate 62, it removes the enabling signal from the AND-gate 54 and no further forward advance pulses can be sent by the AND-gate 54 to advance the step motor to the right.

It is customary for a printing apparatus to contain some means for getting the carriage back to the left margin. This is represented by a carriage-return circuit 64 which may be a key on a keyboard associated with the printing apparatus. The carriage-return circuit 64 emits an output which sets a left control 66 into operation. The left control 66 may be a bistable circuit controlling the output of an oscillator which delivers pulses at a suitable frequency to an input 67 of the reverse-driving circuit 30. The two inputs 29 and 67 of the reverse driving circuit 30 may be combined in an OR-gate as a single input; however, they are shown separated for convenience. The operation of the left control 66 causes the reverse-driving circuit 30 to energize the step motor control 32 to drive the step motor 14 so as to move the carriage 10 to the left toward its left margin.

Leftward movement of the carriage 10, resulting from command signals issued by the reverse-driving circuit 30, also causes the decrement of the left margin counter 46 which decrements toward zero as the carriage 10 moves to the left. The left margin counter 46 reaches zero at the same instant that the carriage 10 reaches the left margin of the paper (not shown). At that instant, the detect-zero output (DET.) of the left-margin counter 46 issues an output signal to an AND-gate 70. The other input of the AND-gate 70 is an inverting input, consequently the detect-zero output from the left margin counter 46 passes through the AND-gate 70 and through an OR-gate 72 in order to reset the left control 66 and thus stop the generation of reverse driving signals from the reverse driving circuit 30.

MANUAL MARGIN SET

In a printing apparatus, it is often desirable to be able manually to set the right and left margins at values that are different from factory-set values. These manually-set margins are generally closer together and give narrower printing fields since the maximum or factory-set margins are limited by the capability of the machine.

It will be recalled that the left margin is determined by the zero count of the left margin counter 46. Consequently, the left margin of printing can be set at any value to the right of the factory-set left margin merely by placing the carriage at that desired location by preferably keyboard-operating means utilizing the space control 56. When the carriage 10 is at the desired manual-left-margin location, a manual-left-margin set circuit 76 is energized. The manual-left-margin set circuit may be a key on the keyboard with which the printing apparatus is associated. The manual-left-margin set circuit 76 issues an output through the OR-gate 44 to set the left-margin counter 46 to zero. Henceforth, the zero count of the left margin counter 46 occurs whenever the carriage 10 is positioned at the manually-established left margin location.

Similarly, the right margin of the printer may be moved by a manual adjustment. The carriage 10 is moved by whatever means is convenient such as the space control 56. When the carriage 10 is at a location corresponding to the desired right margin, a manual-right-margin set 78, which may be a manually-operated key on the keyboard which the operator can depress, issues a set signal to the set-zero input ($S_o$) of the right-margin counter 50 to set the right-margin counter 50 to a count of zero. Consequently, whenever the carriage 10 reaches that same position (that now corresponds to a count of zero in the right margin counter), the detect-zero output of the right margin counter 50 generates a signal to reset and thus disable the space-right control 52, thereby preventing the carriage 10 from being moved any farther to the right.

At any point, the manually-set margins can be cleared simply by energizing a manual-margin-clear control 80 which may be a key on the keyboard. The manual-margin-clear control 80, when energized, sends a signal through the OR-gate 26 to initiate a leftward movement of the carriage in order to duplicate the routine that is used when the power-ON reset circuit 24 initiates a margin set operation. The carriage 10 moves to the left until the screw 18 operates the snap-action switch 20, which disables the step-left circuit 28 and enables the step-right circuit 36. The carriage then steps twelve counts to the right and the counter 42 sets the left-margin counter 46 to zero and sets the right margin counter 50 to a predetermined count.

Manual Margin Release

When the printing apparatus is operating in the manual margin mode in which a substantially narrower printing field has been set by manually setting the right and/or left margins, it is often desired to exceed these margins in either direction. This is permissible because there is ample room on either side of the margins, so long as the maximum margins are not exceeded.

In order to permit exceeding either of the two manual margins, a manual-margin release control 84 is used. The manual margin release may be a key or switch on the keyboard. The output of the manual margin release control 84 energizes the two inverting inputs of the AND-gates 60 and 70. Consequently, the lack of an output from the manual-margin release control 84 normally causes these inverting inputs of the AND-gates 60 and 70 to be in such a state that the signals on the other inputs of both of these AND-gates simply pass through the AND-gates and go on as previously described. However, when a manual margin is to be exceeded, the manual-margin release control 84 issues a signal which removes the enabling inputs of these two AND-gates 60 and 70. Consequently, the zero-detect outputs from the margin counters 46 and 50 cannot pass through the AND-gates 60 and 70. Therefore, further rightward or leftward movement of the carriage is permitted.

However, the step motor 14 cannot be allowed to drive the carriage beyond its maximum margins. Consequently, a left-margin machine counter 88 is provided. The left margin machine counter 88 is essentially the same as the left margin counter 46. However, the left-margin machine counter 88 cannot be manually reset as can the left-margin counter 46. Therefore, no matter what the left-margin counter 46 may be arranged to determine is the left margin, the left-margin machine counter 88 is always zeroed at the factory-set left margin point determined by the output of the counter 42. This output from the counter 42 is delivered to the set-zero input ($S_o$) of the left-margin machine counter 88. The detect-zero output ($DET_o$) of the left-margin machine counter 88 is delivered through the OR-gate 72 to the reset input (R) of the left control 66. Consequently, if the manual-margin release 84 is energized and disables the AND-gate 70 so that the left margin counter 46 cannot pass a signal through the AND-gate 70 and the OR-gate 72 to reset the left control 66, the left machine margin counter 88, when it reaches a zero count, issues a signal at its detect-zero output through the OR-gate 72 to reset the left control 66 in order to prevent the carriage 10 from crashing into the side frame 16.

Similarly, as the carriage is advancing to the right with the manual-margin release 84 energized, the AND-gate 60 is disabled, and the right-margin counter 50, when it reaches zero, cannot send a signal through the OR-gate 62 to reset and thus disable the space-right control 52. However, when the left-margin machine counter 88 reaches a count corresponding to the right margin, a right-margin-machine-detector AND-gate 90 issues a signal through the OR-gate 62 to reset the space-right control 52 in order to prevent the carriage from going too far to the right. While an AND-gate is shown as the right-margin-machine-detector 90, a right margin machine counter identical to the right-margin counter 50 may also be used in place of the right-margin-machine-detector.

While various specific embodiments and examples of the invention have been described in detail above, it will be obvious that various modifications may be made from the specific details described, without departing from the spirit and scope of the invention.

What is claimed is:

1. A method of controlling the printing margins of a printing apparatus having a movable carriage with a frame sensor and a left margin counter and a right margin counter, including the steps of:

moving the carriage to the left until the frame sensor senses proximity of the carriage to the left margin of the printing apparatus;

setting the left-margin counter for a first predetermined count in response to sensing the left margin of the printing apparatus;

setting the right-margin counter to a second predetermined count representative of the distance from the left margin to the right margin of the printing apparatus in response to sensing the left margin of the printing apparatus;

stepping the left margin counter as the carriage moves from left to right;

stepping the right margin counter as the carriage moves from left to right;

sensing when the right margin counter reaches a third predetermined count; and in response to said sensing of said third predetermined count, preventing further rightward movement of the carriage.

2. A method according to claim 1 further including:

stepping the left margin counter as the carriage moves from right to left; and sensing when the left margin counter reaches a fourth predetermined count; and preventing further leftward movement of the carriage in response to sensing said fourth predetermined count in the left margin counter.

3. A method according to claim 2 wherein the carriage is moved to the right by a predetermined amount in response to the operation of the frame sensor prior to setting the margin counters.

4. An improved control for the margins of a printing apparatus having a movable carriage with a frame sensor and a left margin counter and a right margin counter, wherein the improvement comprises:

means responsive to a signal calling for the initialization of the margins of the printing apparatus for moving the carriage to the left;

means responsive to the frame sensor on the carriage for stopping the leftward movement of the carriage and for initiating a predetermined movement of the carriage to the right;

means responsive to the completion of the predetermined rightward movement of the carriage for setting the left margin counter to a first predetermined count;

means responsible to said predetermined rightward movement of the carriage for setting the right margin counter to a second predetermined count characteristic of the number of characters to be printed across the printing apparatus;

means responsive to carriage movement command signals for stepping the left margin counter as the carriage is commanded to move to the right and for stepping the left margin counter as the margin is commanded to move to the left and means responsive to command for movement of the carriage to step the right margin counter as the carriage is commanded to move to the left and for stepping the right margin counter as the carriage is commanded to move to the right.

5. An apparatus according to claim 4 including means responsive to detection of a third predetermined count in the right margin counter for precluding advancing of the carriage to the right.

* * * * *